US008206170B2

(12) United States Patent
Matsumoto et al.

(10) Patent No.: US 8,206,170 B2
(45) Date of Patent: Jun. 26, 2012

(54) MALE AND FEMALE CONNECTORS AND ELECTRICAL CONNECTOR INCLUDING THE SAME

(75) Inventors: Hiroyuki Matsumoto, Yokohama (JP); Shinya Masada, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 13/033,173

(22) Filed: Feb. 23, 2011

(65) Prior Publication Data

US 2011/0207359 A1 Aug. 25, 2011

(30) Foreign Application Priority Data

Feb. 24, 2010 (JP) ..... 2010-039168

(51) Int. Cl.
*H01R 4/50* (2006.01)

(52) U.S. Cl. ..... 439/347

(58) Field of Classification Search ..... 439/347, 439/489

See application file for complete search history.

(56) References Cited

U.S. PATENT DOCUMENTS 5,257,944 A * 11/1993 Kennedy ..... 439/347
5,637,009 A * 6/1997 Tsuji et al. ..... 439/347

FOREIGN PATENT DOCUMENTS

JP 10-50408 2/1998

OTHER PUBLICATIONS

Patent Abstracts of Japan for Japanese Publication No. 10-050408, Publication date Feb. 20, 1998 (1 page).

* cited by examiner

*Primary Examiner* — Phuong Dinh
(74) *Attorney, Agent, or Firm* — Osha • Liang LLP

(57) ABSTRACT

A female housing of the female connector has a slider slidably installed in a direction orthogonal to a longitudinal joining direction. The slider includes a first cam provided with a first ridge portion, and a pair of opposing first and second slanting portions extending from the first ridge portion. The male housing of the male connector is formed with a second cam on an outer wall surface thereof. The second cam provided with a second ridge portion, a third slanting portion coming into abutment and slidably contacting with the first slanting portion of the slider, and a fourth slanting portion being slidably in contact with the second slanting portion and pressed and retained by the second slanting portion. Thus a half-fitted state can be detected and the connectors are prevented from loosening.

15 Claims, 11 Drawing Sheets

MALE AND FEMALE CONNECTORS AND ELECTRICAL CONNECTOR INCLUDING THE SAME

TECHNICAL FIELD

The present invention relates to male and female connectors, and an electrical connector including these connectors. More particularly, the invention relates to male and female connectors, and an electrical connector including these connectors in which a half-fitted state can be detected when these connectors are being joined together.

BACKGROUND ART

Recently, automobiles are equipped with many electric and electronic devices and microcomputers. The microcomputer controls the electric and electronic devices. The electric and electronic devices are connected by means of connection lines such as wire harnesses and flat cables. In order to facilitate the assembly of components and maintenance, the connection of the connection lines is carried out using a pair of male and female connectors that can be easily connected and removed. A variety of male and female connectors of this type are commercially available and utilized. However, a poor connection of connectors may cause a failure. Accordingly, what is proposed is a connector that allows the detection of the joined state of the connectors, specifically, an incompletely joined state that is likely to happen when connectors are being joined together, resulting in the so-called half-fitted state.

For example, JP-A-10-50408 discloses a connector-fitting construction that allows detection of a half-fitted state. In the following, referring to FIGS. 10 and 11, the connector disclosed in JP-A-10-50408 will be described. It is noted that FIG. 10 is an exploded perspective view of male and female connectors and FIG. 11 is a cross-sectional view showing the male and female connectors in a joined state.

The connector fitting construction includes a pair of male and female connectors in which a half-fitted condition is detected when those connectors are being joined together. The male connector 20 includes a predetermined number of socket contacts 21 (see FIG. 11) and a male housing 22 having terminal receiving chambers for receiving the respective socket contacts. The male housing 22 includes a connector housing 22A open to the front side and an exclusive-use housing 22B formed above the connector housing 22A. A slider 30 is slidably mounted in the exclusive-use housing 22B. Guide grooves 23 are provided at both ends of the exclusive-use housing 22B to guide both sides of the slider body. A spring-receiving portion 22C of a tubular shape is provided at each of the rear ends of the guide grooves 23. A lock-arm 24 of a cantilever type made of an elastic member is integrally formed at the middle of the exclusive-use housing 22B to extend in the fitting direction. A lock beak 25 having a slanting surface is formed on the upper surface of the lock arm 24. A housing lock 26 (engagement projection) for retaining engagement with a female housing 41 is formed on the lower surface of the lock arm 24 at the distal end thereof. Displacement prevention projections 26*a* for preventing displacement of the lock arm 24 are formed on that portion of the upper surface of the lock arm 24 facing away from the housing lock 26. Side spaces 27*a* for receiving respective abutment projections of a slider arm are provided on both sides of the lock arm 24.

An elastic slider arm 32 of the cantilever type is formed at the generally central portion of the slider body 31. The slider arm 32 has a pair of abutment projections 34 at both sides of a lower surface thereof at a front end thereof. The slider 30 further includes a press portion 35 formed on an upper surface thereof at a rear end thereof and operated when releasing the fitted condition, a slider groove 33 formed in the slider arm 32 and the press portion 35, and spring retaining portions 36 formed at both sides of the rear end thereof on the lower surface thereof to retain compression springs 38. A displacement prevention portion 37 for preventing displacement of the lock arm 24 is formed at the front end of the slider body 31.

The slider 30 is attached to the male connector 20. More specifically, with the compression springs 38 entering a slider retaining portion 27 from the front side of the male connector 20, the slider 30 is pushed into the slider receiving portion 27. At this time, the abutment projections 34 formed at both sides of the lower surface of the slider arm 32 are disposed in the respective side spaces 27*a* provided on both sides of the lock arm 24. The compression springs 38 are received in the respective spring receiving portions 22C, and the lock beam 25 on the lock arm 24 is fitted in the slide groove 33 of the slider 30. Thus, the slider 30 is slidably mounted. The slider 30 is urged forwardly by the resilient force of the compression springs 38. The front end of the press portion 35 is retained by the lock beak 25 received in the slide groove 33, and the displacement prevention projections 26*a* formed at the front end of the lock arm 24 abut against the displacement prevention portion 37 formed at the lower surface of the front end of the slider 30, so that the lock arm 24 is prevented from being displaced upward.

On the other hand, the female connector 40 includes a predetermined number of pin contacts 45 (see FIG. 11) and a female housing 41 having terminal receiving chambers for receiving the respective pin contacts. The female housing has a housing insertion hole 46 open to the front side. Formed on a surface of the housing 41 are a pair of stopper projections 42 for abutting against the abutment projections 34 of the slider 30 when fitting the connectors together. A slanting projection 43 having a slanting surface for flexing the lock arm 24 is formed between the stopper projections 42. An engagement groove 44 for engagement with the housing lock (engagement projection) 26 is formed adjacent to the rear end of the slanting projections 43.

The operation of fitting the male connector 20 and the female connector 40 together will be described. When the male connector 20 is inserted into the female connector 40, the stopper projections 42 of the female connector 40 are fitted into the respective side spaces 27*a* provided on both sides of the lock arm 24 of the male connector 20, and the stopper projections 42 abut against the respective abutment projections 34 of the slider 30. Upon the abutment, the resilient force of the compression springs 38 is produced. At this stage, the pin contacts 45 in the female connector 40 have not yet been inserted into the respective socket contacts 21 in the male connector 20. Then, when the male connector is further inserted, the slider 30 is pushed rearward against the bias of the compression springs 38, and the housing lock 26 at the front end of the lock arm 24 abuts against the slanting projection 43 of the female connector 40. At this stage, the pin contacts 45 are inserted into the respective socket contacts 21 but are not completely electrically connected thereto. If the pushing operation is stopped in this half-fitted condition, the female and male connectors 40 and 20 are moved away from each other in a disengaging direction (opposite to the fitting direction) by the resilient force of the compression springs 38, and therefore, the half-fitted condition can be easily detected.

Then, when the male connector is further inserted, the slider arm 32 of the slider 30 is flexed upwardly by the lock beak 25, so that abutment of the stopper projections 42 against the abutment projections 34 of the slider 30 is released. Then, the housing lock 26 at the front end of the lock arm 24 slides over the slanting projections 43 and is about to be engaged in the engagement groove 44. Because of the resilient force of the compression springs 38, the slider arm 32 slides over the stopper projections 42, and the housing lock 26 becomes engaged in the engagement groove 44. Accordingly, the slider 30 is returned to its initial position by the resilient force of the compression springs 38, and the displacement prevention portion 37 of the slider 30 abuts against the displacement prevention projections 26*a* of the lock arm 24, thereby locking the lock arm 24. Thus, the male and female connectors are completely fitted together, and their contacts are completely connected with each other. This completely fitted condition can be tactilely detected when the housing lock 26 of the lock arm 24 slides over the slanting projection 43, and also can be easily detected by visually confirming the position of the returned slider 30.

With the connector disclosed in JP-A-10-50408, the half-fitted condition can be detected tactilely when the housing lock of the lock arm slides over the slanting projection when the connectors are being jointed together or by visually confirming the moved position of the slider. However, connectors of this kind, including the connector as described above, are joined in a freely moving state in which the male housing of the male connector and the female housing of the female connector are not firmly joined but rather with a slight gap G (see FIG. 11) formed between the housings even when the connectors are completely fitted after the half-fitted state is detected at a time of fitting together. Such joining in a freely moving state causes the connectors to be displaced in the fitting direction, that is, the longitudinal direction of connection when the connectors are exposed to vibrations. The displacement, which is called rattling, may cause poor contact between the socket contact and the pin contact of the female and male connectors. In particular, if the connectors of this kind are used in vehicles such as automobiles where they are frequently exposed to vibrations, poor contact occurs and may result in a failure. An improvement is thus required.

SUMMARY OF INVENTION

An advantage of some aspects of the present invention is to provide a male connector and a female connector having a structure resistant to vibrations in which a half-fitted state can be detected when the male and female connectors are being joined together, and connector housings are prevented from loosening after being joined.

Another advantage of some aspects of the invention is to provide an electrical connector including the male connector and the female connector.

According to one or more aspects of the invention, a male connector is fitted in and joined with a female connector into which a slider including a first cam projection provided with a first ridge portion, and a pair of opposing first and second slanting portions extending from the first ridge portion by a predetermined length is slidably installed by an elastic member in a direction orthogonal to a longitudinal joining direction. The male connector includes: a predetermined number of contacts with good conductivity, and an electrically insulating male housing in which the contacts are housed. On an outer wall surface of the male housing, the male housing includes a second cam projection provided with a second ridge portion, a third slanting portion extending from the second ridge portion by a predetermined length to come into abutment and slidably contact with the first slanting portion of the slider, and a fourth slanting portion extending from the second ridge portion by a predetermined length to be slidably in contact with the second slanting portion and pressed and retained by the second slanting portion.

In the male connector, according to one or more embodiments, the fourth slanting portion has a first extending slanting portion extending from the second ridge portion by a predetermined length and a second extending slanting portion extending at a slanting angle larger than that of the first extending slanting portion.

In the male connector, according to one or more embodiments, the second cam projection is formed of a wedge-like projection shaped like a triangle, as two-dimensionally viewed, and protruding from the outer wall surface of the male housing by a predetermined height to have a flat upper top surface and a periphery including the third and fourth slanting portions.

According to one or more aspects of the invention, a female connector in which the above-noted male connector is fitted and joined includes: a predetermined number of contacts with good conductivity, electrically connected in contact with the contacts of the male connector; an electrically insulating female housing provided with a portion defining a fitted hole in which the contacts are housed and the male housing is fitted; and a slider installed into the female housing. The female housing includes a portion defining a slider installation hole connected in communication with the fitted hole in a direction orthogonal to a longitudinal joining direction. The slider includes on a slider body a first cam projection provided with a first ridge portion, a first slanting portion extending from the first ridge portion by a predetermined length to come into abutment and slidably contact with the third slanting portion of the male connector, and a second slanting portion extending from the first ridge portion by a predetermined length to be in slidably contact with the fourth slanting portion and pressed and retained by the fourth slanting portion. The slider body is slidably mounted in the installation hole by an elastic member with the first cam projection facing toward the fitted hole.

In the female connector, according to one or more embodiments, the second slanting portion has a first extending slanting portion extending from the first ridge portion by a predetermined length and a second extending slanting portion extending at a slanting angle larger than that of the first extending slanting portion.

In the female connector, according to one or more embodiments, the first cam projection is formed of a wedge-like projection shaped like a triangle, as two-dimensionally viewed, and protruding from a wall surface of the slider body by a predetermined height to have a flat upper top portion and a periphery including the first and second slanting portions.

According to one or more aspects of the invention, an electrical connector includes the above-noted male connector and the above-noted female connector.

When the male connector according to some aspects of the invention is joined to the female connector, the second cam projection of the male housing comes into abutment with the first cam projection of the female connector. A half-fitted state can be tactilely detected by the abutment and by visually confirming the slider movement. After fitting and joining, the first and second cam projections are engaged with each other to prevent loosening of the housings of the connectors, resulting in a connector resistant to vibrations.

According to one or more aspects of the male connector of the invention, the fourth slanting portion has the first extending slanting portion extending from the second ridge portion by a predetermined length and the second extending slanting portion extending at a slanting angle larger than that of the first extending slanting portion. Therefore, after those connectors are fitted together, the first and second cam projections are engaged with each other more firmly to even more reliably prevent loosening of the housings of the connectors.

According to one or more aspects of the male connector of the invention, the second cam projection can be easily formed on the outer wall surface of the male housing.

With the female connector of some aspects of the invention, when the female connector is joined to the male connector, the first cam projection of the female housing comes into abutment with the second cam projection of the male connector. The half-fitted state can be tactilely detected by the abutment and by visually confirming the slider movement. After fitting and joining, the first and second cam projections are pressed and retained by each other to prevent loosening of the housings of the connectors. High resistance to vibrations is thus achieved.

According to one or more aspects of the female connector of the invention, the second slanting portion has the first extending slanting portion extending from the first ridge portion by a predetermined length and the second extending slanting portion extending at a slanting angle larger than that of the first extending slanting portion. Therefore, after the connectors are fitted together, the first and second cam projections are engaged with each other more firmly to even more reliably prevent loosening of the housings of the connectors.

According to one or more aspects of the female connector of the invention, the first cam projection can be easily formed on the wall surface of the slider body.

One or more aspects of the invention provides an electrical connector resistant to vibrations.

BRIEF DESCRIPTION OF THE DRAWINGS

The invention will be described with reference to the accompanying drawings.

DETAILED DESCRIPTION

In the following, one or more embodiments of the invention will be described with reference to the accompanying drawings. It should be understood that the embodiment below is intended by way of examples of a male connector and a female connector that realize the technical concepts of the invention, not by way of limiting the invention to these particular connectors. The invention can be equally well applied to produce other embodiments without departing from the scope and spirit of the claims. Although an electrical connector as described below is a waterproofing connector, general male and female connectors having no seal member are not intended to be excluded.

Figure 1:
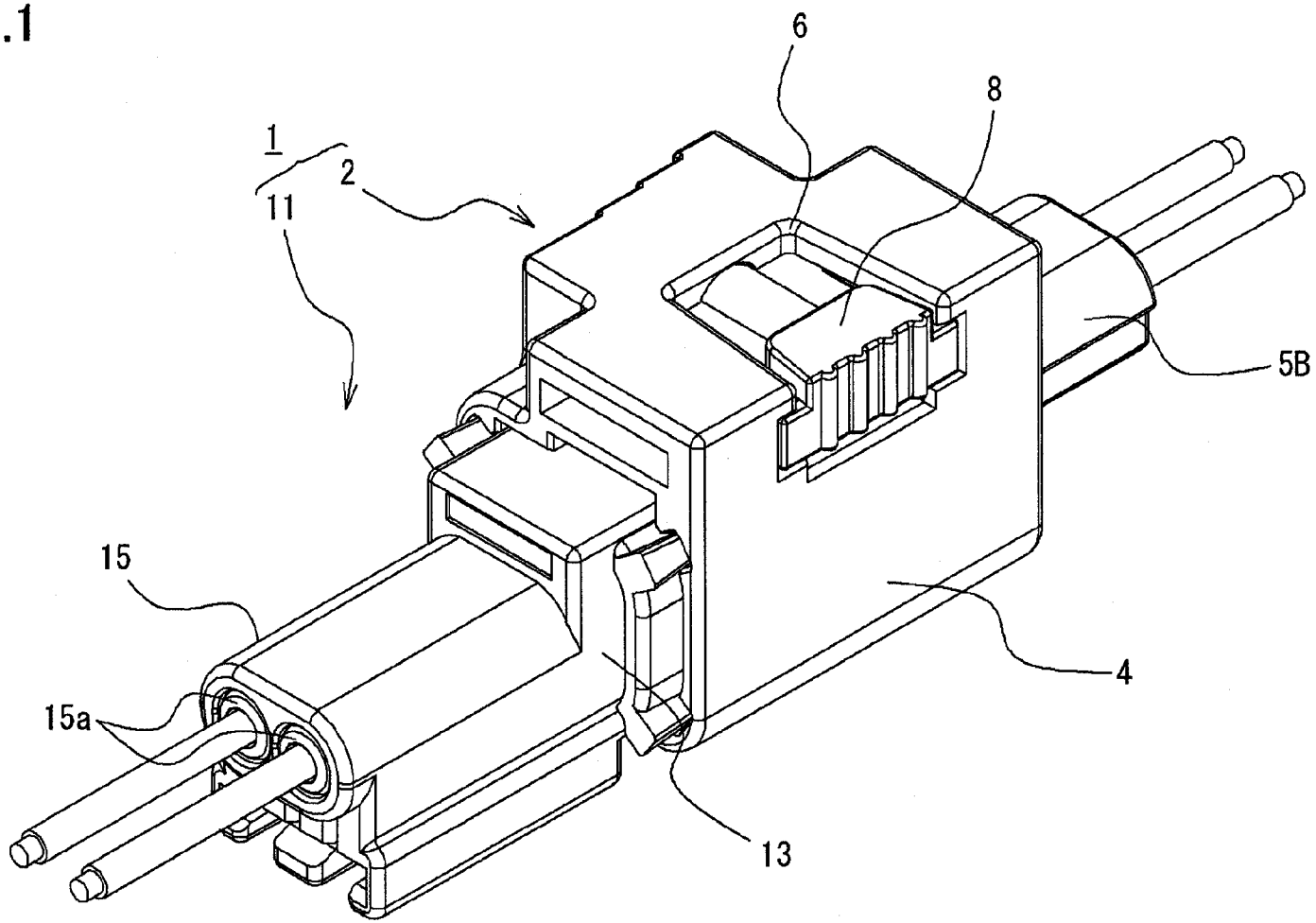
FIG. 1 is a perspective view showing a joined state of a female connector and a male connector of an electrical connector according to one or more embodiments of the invention.
Figure 2:
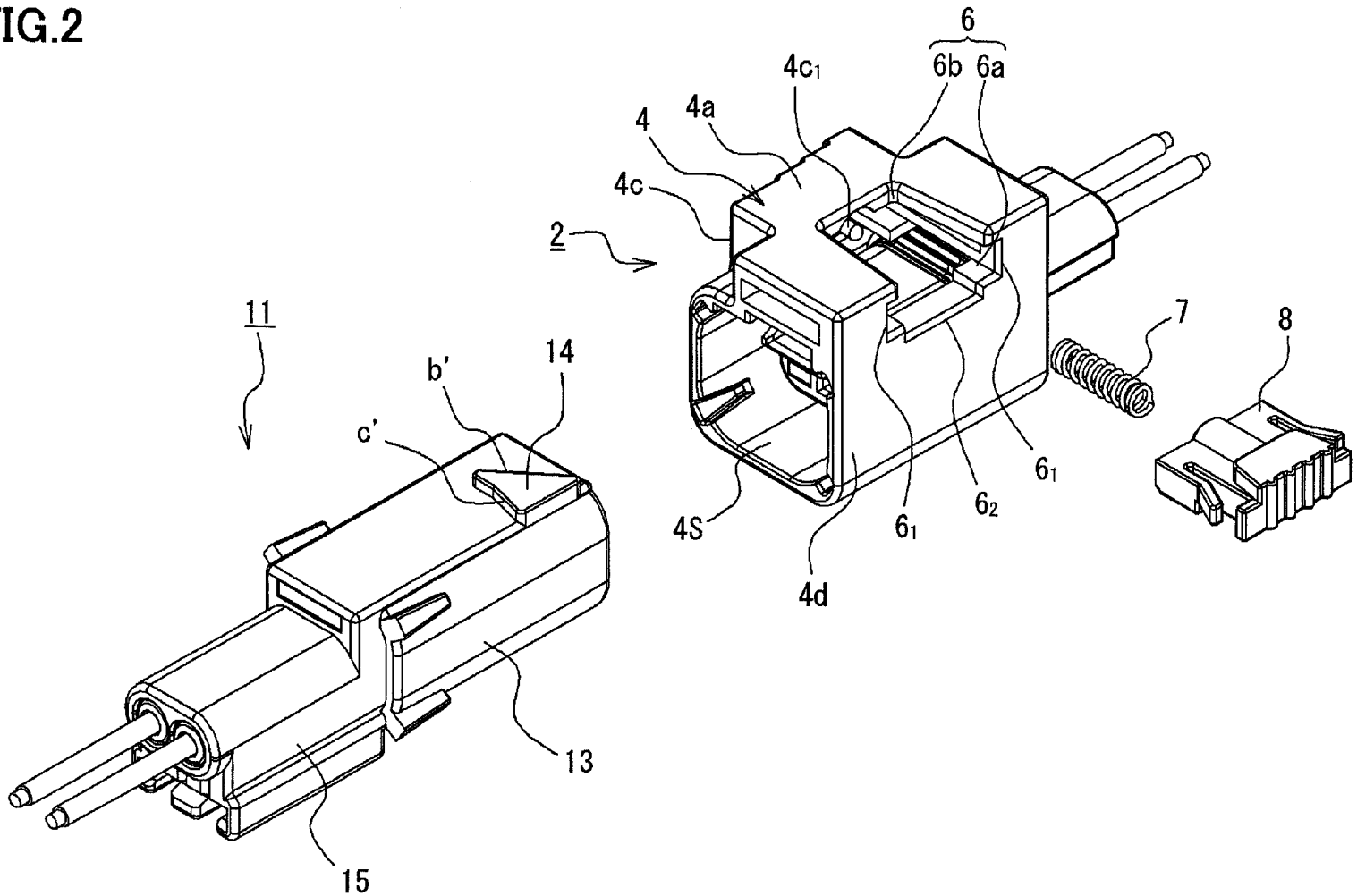
FIG. 2 is an exploded perspective view of the electrical connector in FIG. 1.

Referring to FIGS. 1 and 2, a male connector and a female connector according to one or more embodiments of the invention will be generally described. FIG. 1 is a perspective view showing a state in which the female connector and the male connector are joined together according to one or more embodiments of the invention, and FIG. 2 is an exploded perspective view of the male connector and the female connector in FIG. 1.

An electrical connector 1 according to one or more embodiments of the invention includes a pair of a female connector 2 and a male connector 11, as shown in FIGS. 1 and 2. Electrical wires are connected to the female connector 2 and the male connector 11. The female connector 2 has an installation hole 6 provided in an outer wall of a female housing 4. A slider 8 urged by an elastic member is installed into the installation hole 6. The slider 8 is provided with a first cam projection that allows detection of a half-fitted state and prevents loosening. On the other hand, the male connector 11 is provided with a second cam projection 14 (see FIGS. 7A to 7C) that comes into abutment and engagement with the first cam projection 10 (see FIGS. 6A and 6B) of the slider 8. The electrical wires connected with the female connector 2 and the male connector 11 are each provided with waterproofing seal members 15*a*. Known O-rings, gaskets, or the like can be used as the seal members 15*a*.

When the male connector 11 is inserted into the female connector 2, the first cam projection of the slider 8 comes into abutment with the second cam projection of the male connector 11. The half-fitted state can be tactilely detected upon abutment and by visually confirming the movement of the slider 8. After being fitted and joined, the male and female housings are prevented from loosening, so that good electrical contact between the contacts housed in the male and female housings is maintained. In the following, the configurations of the female connector and the male connector will be detailed.

Figure 3A:
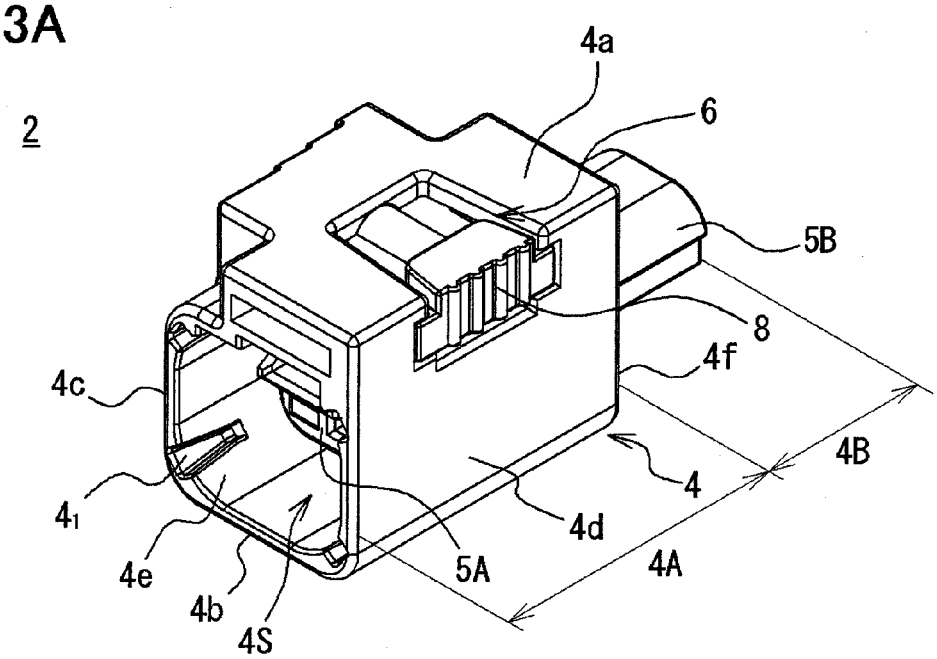
FIG. 3A, FIG. 3B, and FIG. 3C are a perspective view, a front view, and a rear view, respectively, of the female connector.
Figure 3B:
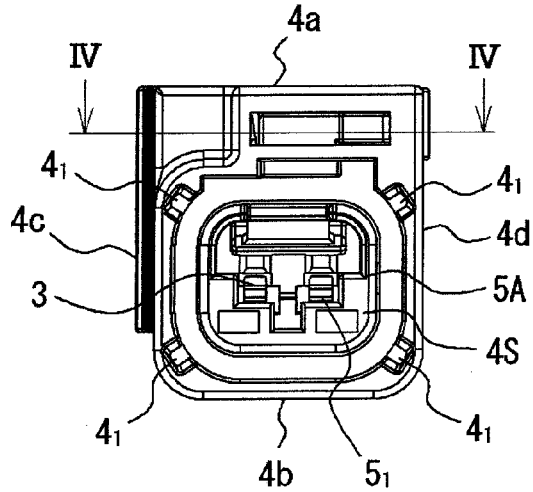
Figure 3C:
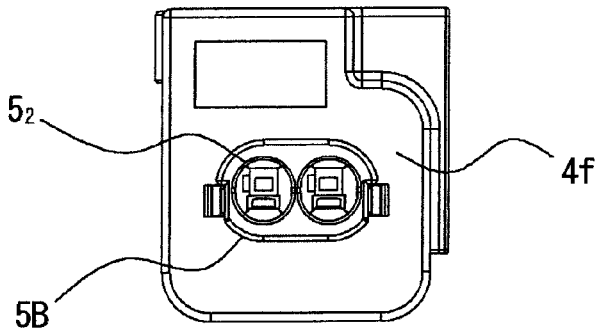
Figure 4:
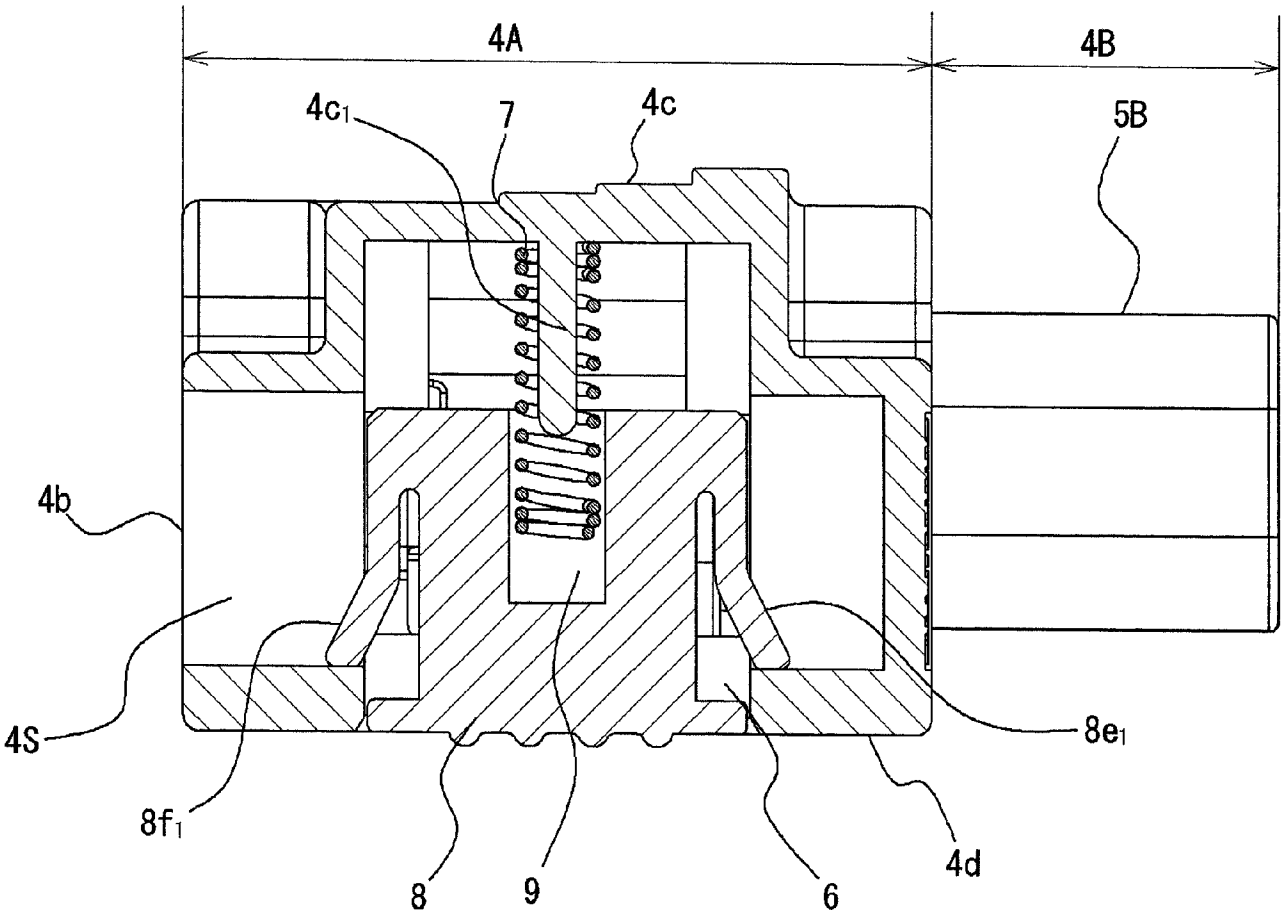
FIG. 4 is a cross-sectional view from along line IV-IV in FIG. 3B.

Referring to FIGS. 3A to 3C and FIG. 4, the female connector will be described. FIG. 3A, FIG. 3B, and FIG. 3C are a perspective view, a front view, and a rear view, respectively, and FIG. 4 is a cross-sectional view from along line IV-IV in FIG. 3B. As shown in FIGS. 3A to FIG. 3C, the female connector 2 includes a predetermined number of contacts 3, a female housing 4 in which these contacts are housed, and a slider 8 which is slidably installed in the female housing with a spring 7 interposed. The contacts 3 are electrically connected in contact with the respective contacts mounted in the male connector 11. Either socket-type contacts or pin-type contacts are selected in accordance with the type of the contacts of the male connector. These contacts are fabricated with a metal material possessing good conductivity.

As shown in FIG. 3A to 3C, The female housing 4 molded of electrically insulating synthetic resin includes a connector joining portion 4A on the front side thereof and a lead wire support portion 4B extending from the connector joining portion rearward by a predetermined length. In the connector joining portion 4A, the male connector 11 is inserted and the slider 8 is also installed. Lead wires connected with the contacts 3 are inserted and supported in the lead wire support portion 4B. The connector joining portion 4A is formed of a tubular body in the shape of a rectangular parallelepiped with a predetermined length, which is enclosed with top and bottom walls 4*a* and 4*b*, and left and right side walls 4*c* and 4*d*, each having an approximately elongated rectangular shape, and has an internal space 4S of a predetermined size. The female housing 4 has an opening 4*e* at the front end thereof, and the internal space 4S is closed at the rear end thereof by a rear wall 4*f*. The space 4S is sized such that the contacts 3 are housed and the male connector 11 is inserted. The space 4S serves as a fitted hole in which the male connector 11 is fitted and joined, with the opening 4*e* at the front end thereof serving as an insertion slot for receiving the male housing 13 of the male connector 11. Inside the space 4S, an attachment projection $4c_1$ for fixing an end of the coil-like spring 7 is formed at an inner wall surface of the side wall 4*c* (see FIG. 4).

At the four corners of the inner wall, wedge-like grooves $4_1$ are formed. Wedge projections $13_1$ (see FIGS. 7A to 7C) of the male connector are inserted in wedge-like grooves $4_1$ when joining with the male connector 11, so that the positioning of the male and female connectors is firmly fixed. A rod-like internal projection portion 5A having the contacts 3 mounted therein is provided inside the space 4S. The internal projection portion 5A extends from the rear wall 4*f* in the direction toward the opening 4*e* by a predetermined length. Mounting holes $5_1$ for receiving the respective contacts 3 are formed in the longitudinal direction of the internal projection portion 5A. The mounting hole $5_1$ is a through hole passing through the rear wall 4*f* and through the external projection portion 5B of the lead wire support portion 4B.

The top wall 4*a* of the female housing 4 is thicker than the other walls. An installation hole 6 is formed at the corner between the top wall 4*a* and the side wall 4*d* to receive the slider 8. As shown in FIG. 2, the installation hole 6 includes an insertion slot 6*a* provided in the side wall 4*d* in the vicinity of the corner and a notch hole 6*b* formed by cutting the top wall 4*a* from the insertion slot toward the other side wall 4*c* by a predetermined depth. The installation hole 6 has a pair of opposing guide grooves $6_1$ at the insertion slot 6*a* and a guide groove $6_2$ for the first cam projection 10 and is connected in communication with the space 4S. Although the installation hole 6 is provided at the corner between the top wall 4*a* and the side wall 4*d* in the present embodiment, it may be provided at the other side wall surface. In such a case, the side wall provided with the installation hole is made thicker similarly to the top wall.

As shown in FIGS. 3A to 3C and FIG. 4, the lead wire support portion 4B is formed of a rod-like external projection portion 5B projecting outward from the rear wall 4*f* by a predetermined length. Through holes $5_2$ in communication with the respective mounting holes $5_1$ are formed in the external projection portion 5B. The through hole $5_2$ is sized such that each contact 3 is inserted and the lead wire connected with the contact is retained.

Figure 5:
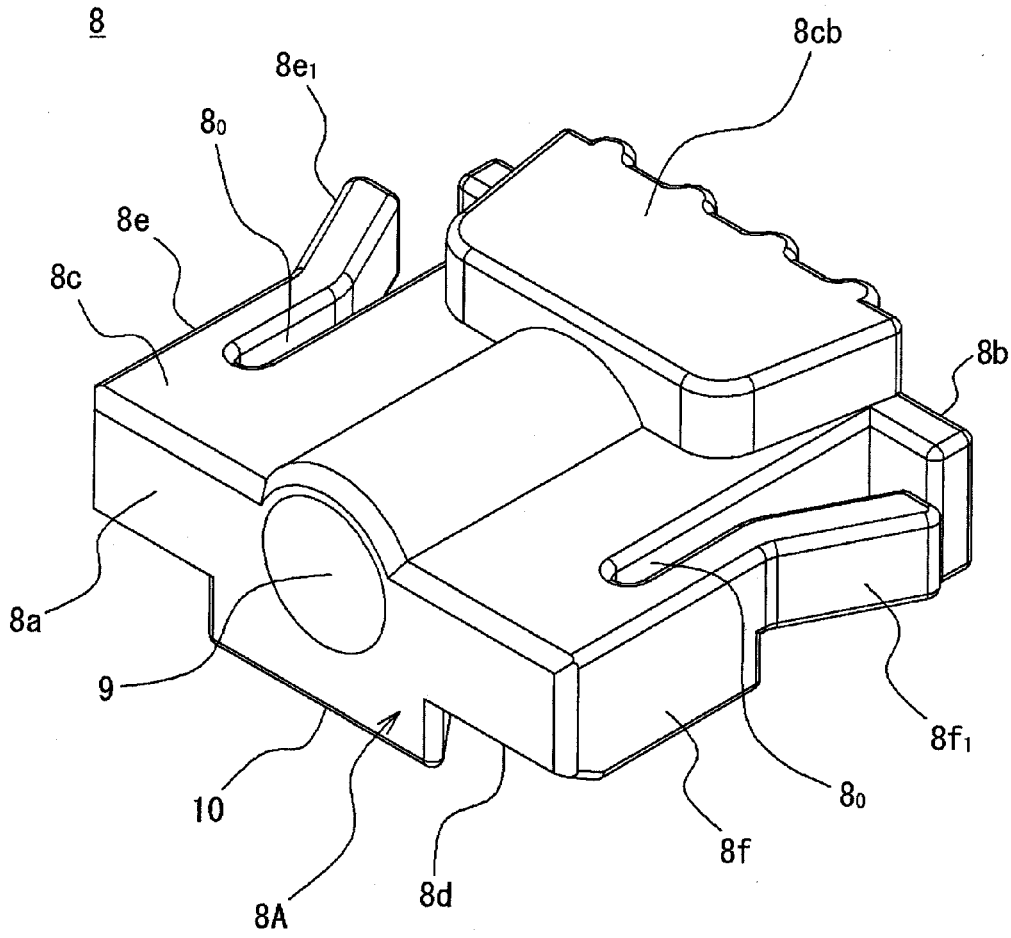
FIG. 5 is a perspective view of a slider.
Figure 6A:
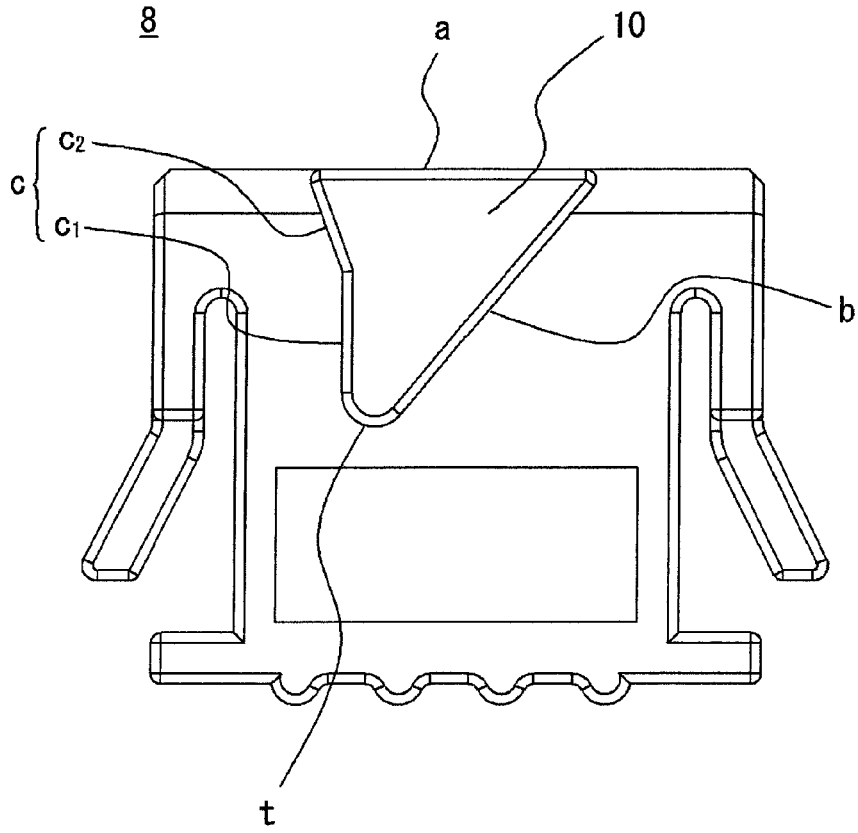
FIG. 6A and FIG. 6B are a rear view and a side view, respectively, of the slider.
Figure 6B:
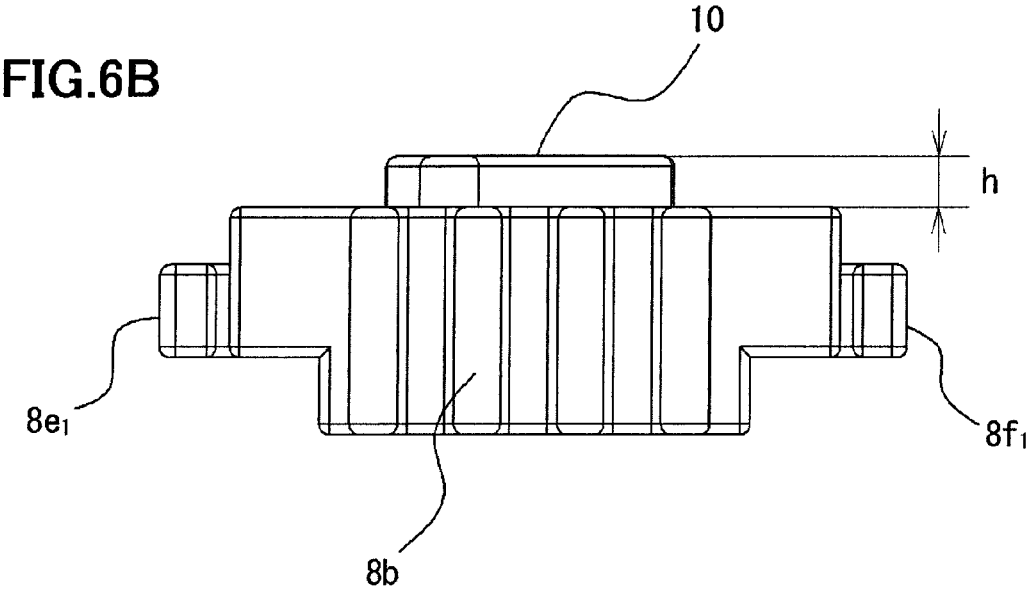

Referring to FIG. 5 and FIGS. 6A and 6B, the slider will now be described. FIG. 5 is a perspective view of the slider body, and FIG. 6A and FIG. 6B are a rear view and a side view, respectively, of the slider body. The slider 8 has a slider body 8A which is slidably installed into the installation hole 6, as shown in FIG. 2 and FIG. 5. In the present embodiment, the slider 8 is formed of one piece of the slider body 8A and therefore, the slider body 8A is also referred to as the slider 8. In other words, the slider may be formed of an assembly of multiple pieces.

The slider body 8A has front and rear walls 8*a* and 8*b*, top and bottom walls 8*c* and 8*d*, and left and right side walls 8*e* and 8*f* and is formed of a synthetic resin molded piece with a predetermined thickness in the shape of an approximately rectangle sized to be inserted in the installation hole 6. Of the top and bottom walls 8*c* and 8*d* of the slider body 8A, the top wall 8*c* protrudes by a predetermined height approximately at the middle thereof, where a spring housing hole is provided. A spring housing hole 9 of a predetermined depth is formed approximately at the middle of the front wall 8*a*. The spring housing hole 9 is a tunnel-like hole of a predetermined depth extending toward the rear wall 8*b*. The coil-like spring 7 is housed in the spring housing hole 9. Lock arms $8e_1$ and $8f_1$ of a cantilever type are formed in the left and right side walls 8*e* and 8*f*, respectively. The cantilever-type lock arms $8e_1$ and $8f_1$ are elastic arm pieces which are fixed to the left and right side walls 8*e* and 8*f*, respectively, at the front wall 8*a* side and extend outward at the rear ends thereof with predetermined spaces $8_0$. A grip projection 8*cb* is formed on the top wall 8*c* such that a part of the top wall 8*c* protrudes from the wall surface on the rear wall 8*b* side by a predetermined height. The grip projection 8*cb* serves as a manipulation part for manipulating the slider 8. Although one spring housing hole is provided in the slider here, a plurality of spring housing holes may be provided. When a plurality of spring housing holes are provided, a plurality of coil-like springs are also provided.

On the bottom wall 8*d*, as shown in FIG. 6A, a wedge-like cam projection (hereinafter referred to as the first cam projection) 10 shaped like a triangle, as two-dimensionally viewed, and having an acute ridge portion (hereinafter referred to as the first ridge portion) at the tip end thereof is formed to protrude from the bottom wall surface by a predetermined height h. The first cam projection 10 has a base portion a of a predetermined length (the shorter side) extending from the rear wall 8*b* and a pair of opposing slanting portions (hereinafter referred to as the first and second slanting portions) b and c extending from both ends of the base portion at an acute angle. The acute ridge portion t is formed at the vertex where the first and second slanting portions b and c join each other. Since the first cam projection 10 protrudes from the surface of the bottom wall 8*d* by a predetermined height h, a pair of the first and second slanting portions b and c are formed of slanting surfaces, each having a width corresponding to the height h. It is noted that the first cam projection, and the first and second slanting portions are designated to be distinguished from and associated with the second cam projection, and the third and fourth slanting portions of the male connector as described later, for ease of explanation.

Of the first and second slanting portions b and c, the first slanting portion b serves as a slide portion which comes into abutment with the third slanting portion of the male connector 11 to slide whereby the slider 8 slidably moves in the direction orthogonal to the joining direction. On the other hand, after the ridge portion t goes over the second ridge portion t' of the male connector 11, the second slanting portion c comes into contact with the fourth slanting portion c' and then slides because of the resilient force of the coil-like spring 7 to push the male housing 13 of the male connector 11 in the joining direction. By maintaining this state, the second slanting portion c serves the function of preventing loosening of the housings of the connectors.

The second slanting portion c includes, as shown in FIG. 6A, a first extending slanting portion $c_1$ that comes into contact with a first extending slanting portion $c_1'$ (see FIG. 7A) of the fourth slanting portion c' of the male connector 11 and then slides after the ridge portion t goes over the second ridge portion t' of the male connector 11, and a second extending slanting portion $c_2$ extending rearward from the first extending slanting portion $c_1$ at a larger angle to push the male housing 13 of the male connector 11 in the joining direction. The angle of the second extending slanting portion $c_2$ is set such that no gap is formed between the housings 4 and 13. Since the half-fitted state can be detected by slidably moving the slider 8 and the housings 4 and 13 are prevented from loosening, the first cam projection 10 has both the function of detecting the half-fitted state and the function of preventing loosening. The slider 8 can be easily fabricated because of the simple shape of the slider body 8A. In addition, the molding required to fabricate the slider 8 is also formed in a simple shape, and therefore, the costs can be reduced.

The slider 8 is installed into the installation hole 6. In the installation process, one end of the coil-like spring 7 is inserted into the attachment projection $4c_1$ in the space 4S and the other end of the coil-like spring 7 is put into the spring housing hole 9 of the slider body 8A. In this state, with the first cam projection 10 facing toward the inside of the space 4S, the slider 8 is pushed into the installation hole 6 against the elastic force of a pair of the cantilever-type lock arms $8e_1$ and $8f_1$. As a result of this pushing, as shown in FIG. 4, a pair of the cantilever-type lock arms $8e_1$ and 8*f*1 returns to the original state and abuts against the inner wall surface of the side wall 4*d* so as not to be disconnected.

The slider 8, which is installed in the female housing 4 to be engaged with the second cam projection 14 (see FIG. 7A to 7C) of the male connector 11, serves the functions of detecting the half-fitted state and preventing loosening. The female housing 4 requires no spring mechanism as in the conventional technique and can be easily fabricated.

Figure 7A:
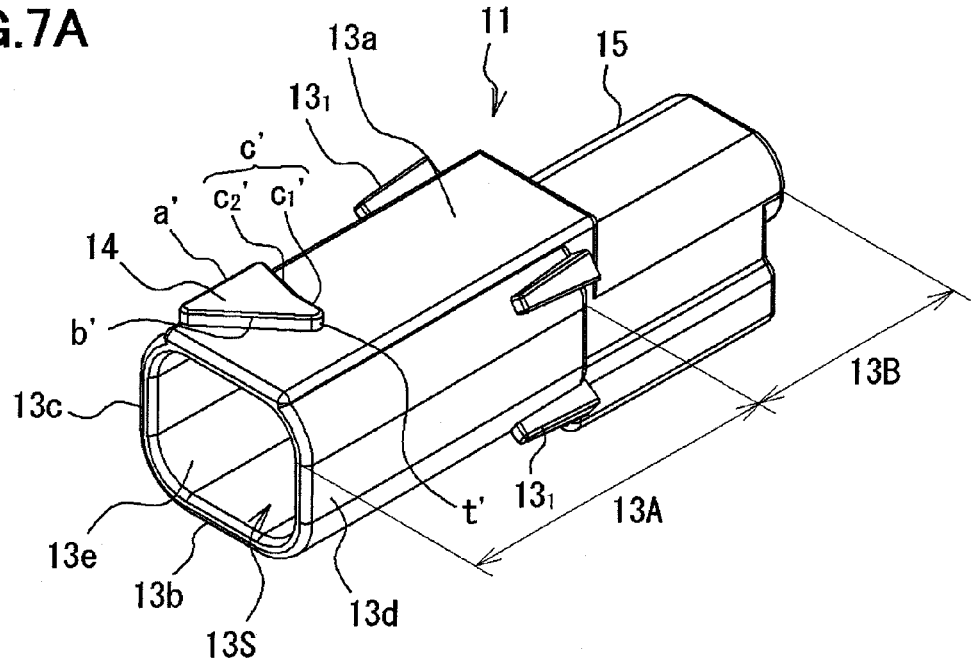
FIG. 7A, FIG. 7B, and FIG. 7C are a perspective view, a front view, and a rear view, respectively, of the male connector.
Figure 7B:
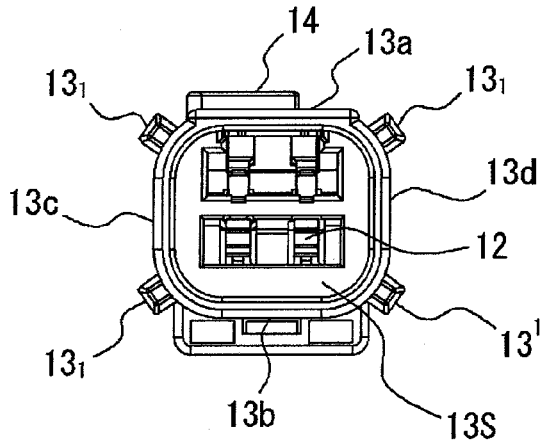
Figure 7C:
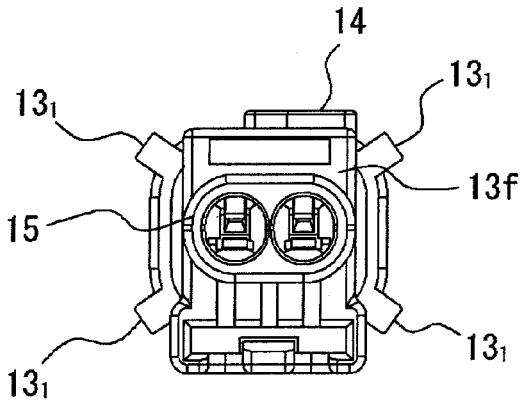

Referring to FIGS. 7A to 7C, the male connector will now be described. FIG. 7A, FIG. 7B, and FIG. 7C are a perspective view, a front view, and a rear view, respectively, of the male connector. As shown in FIGS. 7A to 7C, the male connector 11 has a predetermined number of contacts 12 and a male housing 13 in which the contacts 12 are housed. On a wall surface of the male housing 13, a second cam projection 14 is formed, which comes into abutment with the first cam projection 10 of the female connector 2 and assists the female connector 2 in the actions of detecting the half-fitted state and preventing loosening. The contacts 12 are either socket-type contacts or pin-type contacts corresponding to the shape of the contacts 3 of the female connector 2. These contacts are fabricated with a metal material possessing good conductivity.

As shown in FIG. 7A, the male housing 13 molded of electrically insulating synthetic resin includes a connector insertion portion 13A at the front thereof to be inserted into the female connector 2 and a lead wire support portion 13B extending rearward from the connector insertion portion 13A to support the lead wires connected with the contacts 12. The connector insertion portion 13A is formed of a tubular body in the shape of a rectangular parallelepiped with a predetermined length, which is enclosed with top and bottom walls 13*a* and 13*b* and left and right side walls 13*c* and 13*d*, each having a rectangular shape, and has an internal space 13S of a predetermined size. The tubular body has an opening 13*e* at the front thereof and is closed with a rear wall 13*f* at the back of the space 13S. The contacts 12 are housed in the space 13S. At the four corners of the outer wall, wedge projections $13_1$ are formed. When joining with the female connector 2, the wedge projections $13_1$ are inserted into the respective wedge-like grooves $4_1$ of the female connector, so that the positioning of the female and male connectors 2 and 11 is firmly fixed.

As shown in FIGS. 7A to 7C, the lead wire support portion 13B is formed of a rod-like external projection portion 15 projecting outward by a predetermined length from the rear wall 13*f*. Through holes in communication with the space 13S are formed in the external projection portion 15. The through holes are sized such that each contact 12 is inserted and the lead wire connected with the contact is retained.

As shown in FIG. 7A, the wedge-like second cam projection 14 shaped like a triangle, as two-dimensionally viewed, and having an acute angle vertex at the tip end thereof is formed on the top wall 13*a* to protrude from the top wall surface by a predetermined height. The cam projection 14 has the protruding height almost identical to that of the first cam projection 10 and has an identical or similar shape to that of the first cam projection 10. Shaped in this manner, the cam projection can be easily fabricated and has a good appearance.

The second cam projection 14 has a base portion a' of a predetermined length (the shorter side) extending from the side wall 13*c* surface, and third and fourth slanting portions b' and c' extending from both ends of the base portion a' at an acute angle. A second ridge portion t' is formed at the vertex where the third and fourth slanting portions b' and c' join each other. Since the second cam projection 14 protrudes from the surface of the top wall 13*a* by a predetermined height, the slanting portions b' and c' are formed to have a width corresponding to the above-noted height. Of the third and fourth slanting portions b' and c', the third slanting portion b' serves as a slide portion which comes into abutment with the first slanting portion b of the female connector 2 to cause the first slanting portion b to slide whereby the slider 8 installed in the female connector 2 slidably moves in the direction orthogonal to the joining direction. On the other hand, after the second ridge portion t' abuts against the first ridge portion t of the female connector 2, the fourth slanting portion c' slips over the second slanting portion c because of the resilient force of the coil-like spring 7 whereby the male housing 13 of the male connector 11 is pushed in the joining direction. By maintaining this state, the fourth slanting portion c' serves the function of preventing loosening of the housings 4 and 13 of the connectors 2 and 11.

Figure 8A:
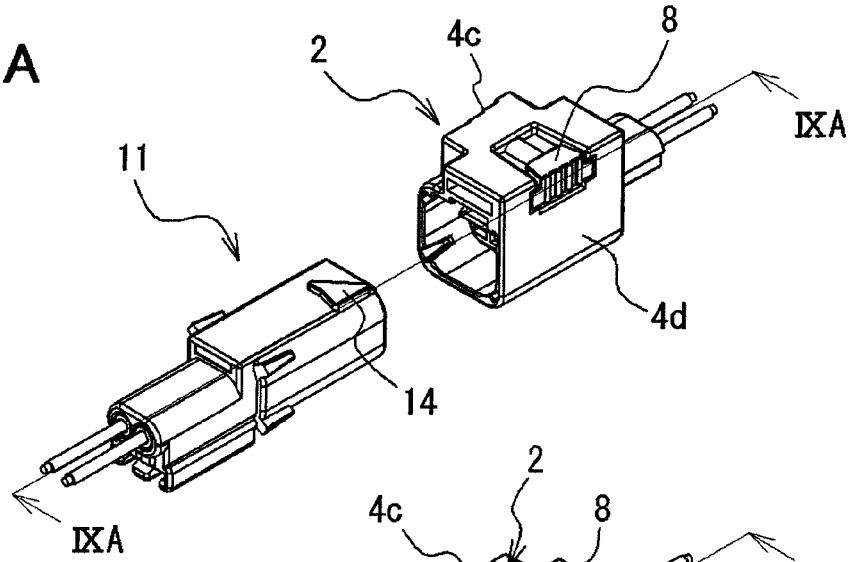
FIGS. 8A to 8D are external perspective views showing the process of joining the female connector and the male connector together.
Figure 8B:
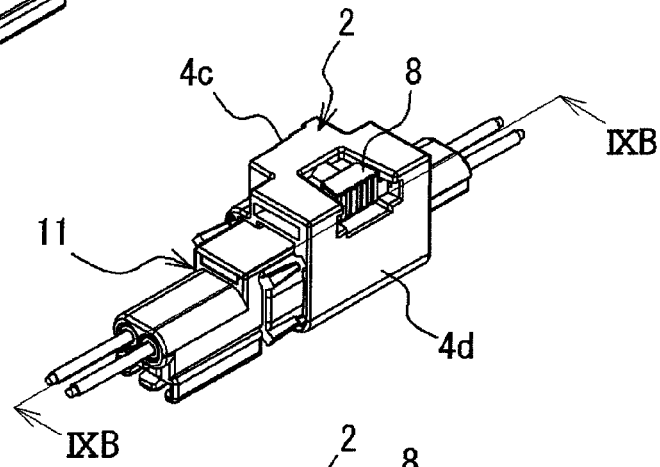
Figure 8C:
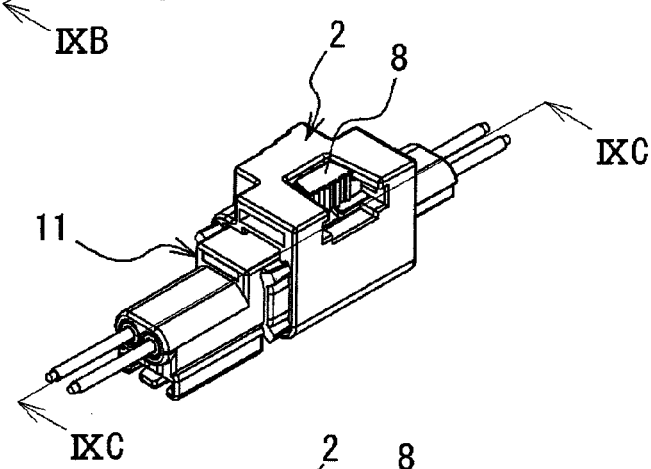
Figure 8D:
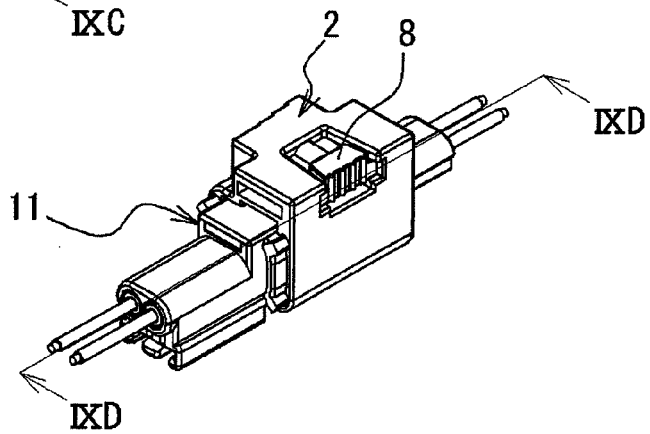
Figure 9A:
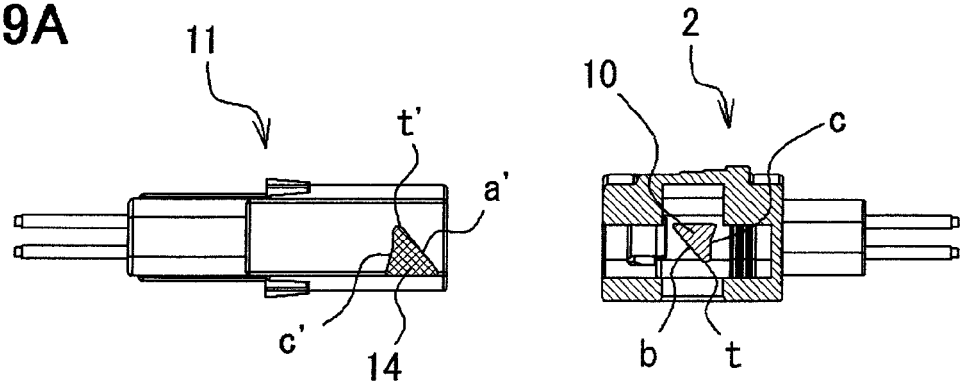
FIGS. 9A to 9D are cross-sectional views corresponding to the joining process shown in FIG. 8.
Figure 9B:
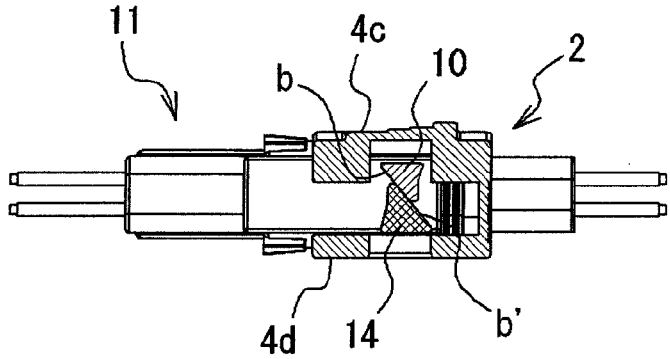

Referring to FIGS. 8A to 8D and FIG. 9A to 9D, the joining action between the female connector and the male connector will be described. FIGS. 8A to 8D are external perspective views showing the joining process between the female connector and the male connector, and FIGS. 9A to 9D are cross-sectional views corresponding to the joining process in FIGS. 8A to 8D. Starting from a non-joined state (FIG. 8A, FIG. 9A), the female connector 2 and the male connector 11 are fitted and joined through the sequential processes shown in FIG. 8B to FIG. 8D. In the non-fitted state, the first cam projection 10 of the slider 8 installed in the female connector 2 is positioned at approximately the central portion in the longitudinal direction of the female connector 2 (see FIG. 8A, FIG. 9A). When the male connector 11 is inserted into the female connector 2, the third slanting portion b' of the second cam projection 14 of the male connector 11 comes into abutment with the first slanting portion b of the first cam projection 10 of the female connector 2 and then slides to push the first slanting portion b. When the first slanting portion b is pushed, the first cam projection 10 moves from the longitudinally central portion toward the side wall 4*d* of the female housing 4, as shown in FIG. 9B. This movement allows the slider 8 to be retracted into the installation hole 6, as shown in FIG. 8B. In this state, the contact 3 and contact 12 have not yet been connected completely.

Figure 9C:
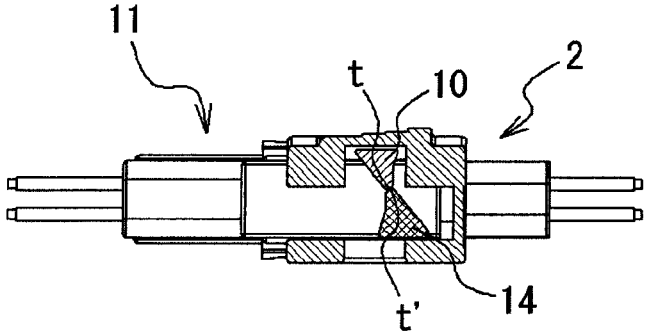
Figure 9D:
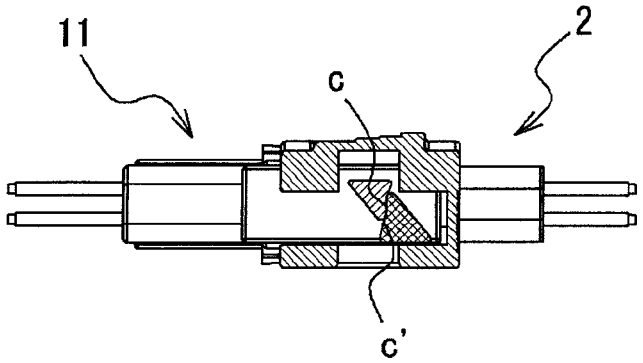
Figure 10:
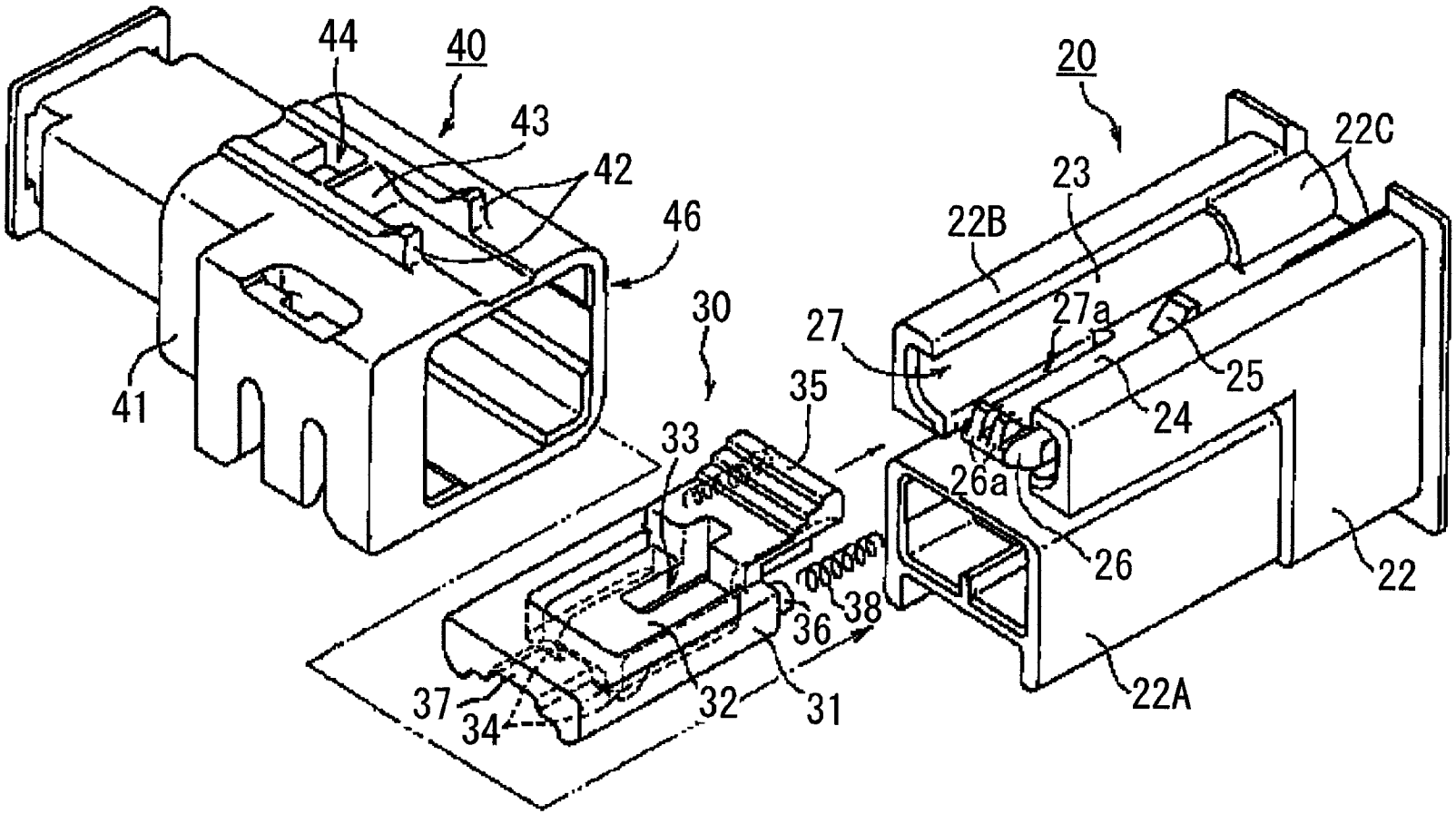
FIG.10 (PRIOR ART)
FIG. 10 is an exploded perspective view of male and female connectors of a conventional technique.
Figure 11:
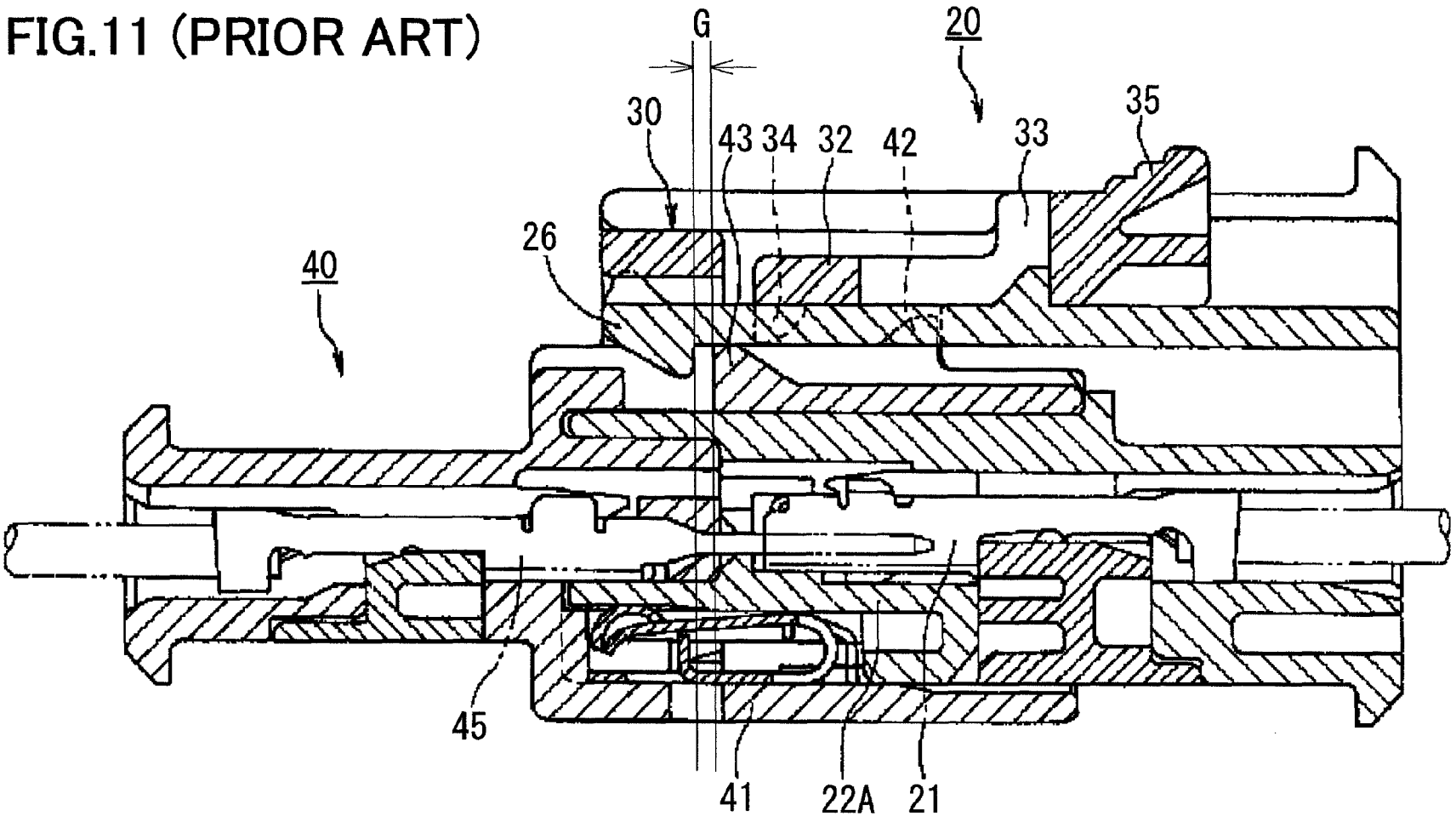
FIG.11 (PRIOR ART)
FIG. 11 is a cross-sectional view showing the male and female connectors of FIG. 10 in a joined state.

When the male connector 11 is further pushed in, as shown in FIG. 9C, the second ridge portion t' of the second cam projection 14 of the male connector 11 and the first ridge portion t of the first cam projection 10 abut against each other at their vertexes. Here, the coil-like spring 7 is compressed from an expanding state. The abutment between the ridge portions t and t' brings the slider body 8A against the expanding force of the coil-like spring 7 to cause the slider 8 to be retracted further into the installation hole 6, as shown in FIG. 8C. When the male connector 11 is pushed in still further, as shown in FIG. 9D, the second ridge portion t' disengages from the first ridge portion t, and the second slanting portion c of the slider 8 slips over the fourth slanting portion c' because of the resilient force of the spring 7. At this point, a fitting sound is produced whereby the shifting to a completely fitted state can be sensed. Accordingly, the male housing of the male connector 11 is pushed in the joining direction and brought into the completely fitted state, so that the contact 12 and the contact 3 are completely connected in contact with each other.

The second and fourth slanting portions c and c' are provided with the first and second extending slanting portions $c_1$, $c_2$ and $c_1'$, $c_2'$, respectively. Thus, when the first ridge portion t disengages from the first ridge portion t', initially, the first extending slanting portion $c_1$ of the second slanting portion c of the slider 8 slides on and presses the first extending slanting portion $c_1'$ of the fourth slanting portion c' because of the resilient force of the spring 7 thereby to push the male housing 13 of the male connector 11 in the joining direction. Then, the second extending slanting portion $c_2$ of the second slanting portion c slides and rests on the second extending slanting portion $c_2'$ of the fourth slanting portion c' thereby to push the male housing 13 of the male connector 11 further in the joining direction. Thus, the connectors are firmly fitted together.

This fitted and joined state is maintained by the spring force of the spring 7, so that the female connector and the male connector are prevented from loosening and no longer rattle. Therefore, in the process of fitting and joining, the engagement between the first and second cam projections provides the tactile sensation of fitting, and the movement of the slider prevents the half-fitted state. Moreover, after being fitted, the connectors are prevented from loosening with the completely fitted state being maintained, so that the female connector and the male connector are resistant to vibrations with good electrical connection being maintained between the contacts of those connectors.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A male connector fitted in and joined with a female connector into which a slider including a first cam projection provided with a first ridge portion, and a pair of opposing first and second slanting portions extending from the first ridge portion by a predetermined length is slidably installed by an elastic member in a direction orthogonal to a longitudinal joining direction, the male connector comprising:

a predetermined number of contacts with good conductivity; and an electrically insulating male housing in which the contacts are housed;

on an outer wall surface of the male housing, the male housing including a second cam projection provided with a second ridge portion, a third slanting portion extending from the second ridge portion by a predetermined length to come into abutment and slidably contact with the first slanting portion of the slider, and a fourth slanting portion extending from the second ridge portion by a predetermined length to be slidably in contact with the second slanting portion and pressed and retained by the second slanting portion.

2. The male connector according to claim 1, wherein the second cam projection is formed of a wedge-like projection shaped like a triangle, as two-dimensionally viewed, and protruding from the outer wall surface of the male housing by a predetermined height to have a flat upper top surface and a periphery including the third and fourth slanting portions.

3. The male connector according to claim 1, wherein the fourth slanting portion has a first extending slanting portion extending from the second ridge portion by a predetermined length and a second extending slanting portion extending at a slanting angle larger than that of the first extending slanting portion.

4. The male connector according to claim 3, wherein the second cam projection is formed of a wedge-like projection shaped like a triangle, as two-dimensionally viewed, and protruding from the outer wall surface of the male housing by a predetermined height to have a flat upper top surface and a periphery including the third and fourth slanting portions.

5. A female connector in which the male connector according to claim 1 is fitted and joined, the female connector comprising:

a predetermined number of contacts with good conductivity, electrically connected in contact with the contacts of the male connector;

an electrically insulating female housing provided with a portion defining a fitted hole in which the contacts are housed and the male housing is fitted; and a slider installed into the female housing;

the female housing including a portion defining a slider installation hole connected in communication with the fitted hole in a direction orthogonal to a longitudinal joining direction, the slider including on a slider body a first cam projection provided with a first ridge portion, a first slanting portion extending from the first ridge portion by a predetermined length to come into abutment and slidably contact with the third slanting portion of the male connector, and a second slanting portion extending from the first ridge portion by a predetermined length to be in slidably contact with the fourth slanting portion and pressed and retained by the fourth slanting portion, the slider body being slidably mounted in the installation hole by an elastic member with the first cam projection facing toward the fitted hole.

6. The female connector according to claim 5, wherein the first cam projection is formed of a wedge-like projection shaped like a triangle, as two-dimensionally viewed, and protruding from a wall surface of the slider body by a predetermined height to have a flat upper top portion and a periphery including the first and second slanting portions.

7. The female connector according to claim 5, wherein the second slanting portion has a first extending slanting portion extending from the first ridge portion by a predetermined length and a second extending slanting portion extending at a slanting angle larger than that of the first extending slanting portion.

8. The female connector according to claim 7, wherein the first cam projection is formed of a wedge-like projection shaped like a triangle, as two-dimensionally viewed, and protruding from a wall surface of the slider body by a predetermined height to have a flat upper top portion and a periphery including the first and second slanting portions.

9. An electrical connector comprising:

a female connector; and a male connector fitted in and joined with the female connector;

the male connector having a predetermined number of contacts with good conductivity and an electrically insulating male housing in which the contacts are housed;

the female connector having a predetermined number of contacts with good conductivity, electrically connected in contact with the contacts of the male connector, an electrically insulating female housing provided with a portion defining a fitted hole in which the contacts are housed and the male housing is fitted, and a slider installed into the female housing;

the female housing including a portion defining a slider installation hole connected in communication with the fitted hole in a direction orthogonal to a longitudinal joining direction;

the slider including having a slider body, and a first cam projection provided on the slider body with a first ridge portion, and a pair of opposing first and second slanting portions extending from the first ridge portion by a predetermined length;

the slider body being slidably mounted in the installation hole by an elastic member with the first cam projection facing toward the fitted hole in the direction orthogonal to the longitudinal joining direction;

on an outer wall surface of the male housing, the male housing including a second cam projection provided with a second ridge portion, a third slanting portion extending from the second ridge portion by a predetermined length to come into abutment and slidably contact with the first slanting portion of the slider, and a fourth slanting portion extending from the second ridge portion by a predetermined length to be slidably in contact with the second slanting portion and pressed and retained by the second slanting portion.

10. The electrical connector according to claim 9, wherein the first cam projection of the female connector is formed of a wedge-like projection shaped like a triangle, as two-dimensionally viewed, and protruding from a wall surface of the slider body by a predetermined height to have a flat upper top portion and a periphery including the first and second slanting portions; and the second cam projection of the male connector is formed of a wedge-like projection shaped like a triangle, as two-dimensionally viewed, and protruding from the outer wall surface of the male housing by a predetermined height to have a flat upper top surface and a periphery including the third and fourth slanting portions.

11. The electrical connector according to claim 9, wherein the second slanting portion of the first cam projection of the female connector has a first extending slanting portion extending from the first ridge portion by a predetermined length and a second extending slanting portion extending at a slanting angle larger than that of the first extending slanting portion; and the fourth slanting portion of the second cam projection of the male connector has a third extending slanting portion extending from the second ridge portion by a predetermined length and a forth extending slanting portion extending at a slanting angle larger than that of the first extending slanting portion.

12. The electrical connector according to claim 11, wherein the first cam projection of the female connector is formed of a wedge-like projection shaped like a triangle, as two-dimensionally viewed, and protruding from a wall surface of the slider body by a predetermined height to have a flat upper top portion and a periphery including the first and second slanting portions; and the second cam projection of the male connector is formed of a wedge-like projection shaped like a triangle, as two-dimensionally viewed, and protruding from the outer wall surface of the male housing by a predetermined height to have a flat upper top surface and a periphery including the third and fourth slanting portions.

13. A female connector in which the male connector according to claim 2 is fitted and joined, the female connector comprising:

a predetermined number of contacts with good conductivity, electrically connected in contact with the contacts of the male connector;

an electrically insulating female housing provided with a portion defining a fitted hole in which the contacts are housed and the male housing is fitted; and a slider installed into the female housing;

the female housing including a portion defining a slider installation hole connected in communication with the fitted hole in a direction orthogonal to a longitudinal joining direction, the slider including on a slider body a first cam projection provided with a first ridge portion, a first slanting portion extending from the first ridge portion by a predetermined length to come into abutment and slidably contact with the third slanting portion of the male connector, and a second slanting portion extending from the first ridge portion by a predetermined length to be in slidably contact with the fourth slanting portion and pressed and retained by the fourth slanting portion, the slider body being slidably mounted in the installation hole by an elastic member with the first cam projection facing toward the fitted hole.

14. A female connector in which the male connector according to claim 3 is fitted and joined, the female connector comprising:

a predetermined number of contacts with good conductivity, electrically connected in contact with the contacts of the male connector;

an electrically insulating female housing provided with a portion defining a fitted hole in which the contacts are housed and the male housing is fitted; and a slider installed into the female housing;

the female housing including a portion defining a slider installation hole connected in communication with the fitted hole in a direction orthogonal to a longitudinal joining direction, the slider including on a slider body a first cam projection provided with a first ridge portion, a first slanting portion extending from the first ridge portion by a predetermined length to come into abutment and slidably contact with the third slanting portion of the male connector, and a second slanting portion extending from the first ridge portion by a predetermined length to be in slidably contact with the fourth slanting portion and pressed and retained by the fourth slanting portion, the slider body being slidably mounted in the installation hole by an elastic member with the first cam projection facing toward the fitted hole.

15. A female connector in which the male connector according to claim 4 is fitted and joined, the female connector comprising:

a predetermined number of contacts with good conductivity, electrically connected in contact with the contacts of the male connector;

an electrically insulating female housing provided with a portion defining a fitted hole in which the contacts are housed and the male housing is fitted; and a slider installed into the female housing;

the female housing including a portion defining a slider installation hole connected in communication with the fitted hole in a direction orthogonal to a longitudinal joining direction, the slider including on a slider body a first cam projection provided with a first ridge portion, a first slanting portion extending from the first ridge portion by a predetermined length to come into abutment and slidably contact with the third slanting portion of the male connector, and a second slanting portion extending from the first ridge portion by a predetermined length to be in slidably contact with the fourth slanting portion and pressed and retained by the fourth slanting portion, the slider body being slidably mounted in the installation hole by an elastic member with the first cam projection facing toward the fitted hole.

* * * * *